US006405552B1

(12) United States Patent
Hubert et al.

(10) Patent No.: US 6,405,552 B1
(45) Date of Patent: Jun. 18, 2002

(54) COIL SUPPORT PAN FOR AN AIR HANDLING UNIT

(75) Inventors: Delcy Elste Hubert; Mauricio Fernandes Barbosa de Carvalho, both of Porto Alegre (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/913,642

(22) PCT Filed: Dec. 30, 1999

(86) PCT No.: PCT/BR99/00116

§ 371 (c)(1),
(2), (4) Date: Aug. 17, 2001

(87) PCT Pub. No.: WO01/50070

PCT Pub. Date: Jul. 12, 2001

(51) Int. Cl.[7] ..... F25D 21/14
(52) U.S. Cl. ..... 62/285; 62/291
(58) Field of Search ..... 62/285, 288, 291; 220/571

(56) References Cited

U.S. PATENT DOCUMENTS

| | | | | |
|---|---|---|---|---|
| 4,856,672 A | | 8/1989 | Sullivan | 220/82 |
| 4,907,420 A | * | 3/1990 | Mahanay et al. | 62/285 |
| 5,195,332 A | | 3/1993 | Sullivan | 62/291 |
| 5,392,944 A | * | 2/1995 | Jennings | 220/571 |
| 5,669,230 A | | 9/1997 | Timmons et al. | 62/285 |
| 5,966,958 A | * | 10/1999 | Maynard | 62/277 |

FOREIGN PATENT DOCUMENTS

| | | |
|---|---|---|
| EP | 625679 | 11/1994 |

* cited by examiner

*Primary Examiner*—William E. Tapolcai

(57) ABSTRACT

A support pan for a heat exchange coil in an air handling unit includes a top wall made from a polymeric/co-polymeric material. The top wall includes an outer periphery and defines a coil support region and a condensate collecting region. A bottom wall is substantially co-extensive with the top wall and has an outer periphery substantially coincident with that of the top wall. Peripheral support channels structurally engages the outer peripheries of the top wall and the bottom wall and supports the walls in substantially parallel spaced relationship with one another to define a confined space therebetween. The coil support region of the top wall includes a plurality of parallel coil support segments. Each of the support segments defines an upwardly facing support surface configured to contact and support a lower end of a coil at a predetermined elevation. The support segments are spaced from one another by a plurality of condensate collecting channels which are at an elevation lower than the predetermined elevation. The condensate collecting channels are in fluid communication with the condensate collecting region, which is at an elevation lower than that of the condensate collecting channels. An insulating material, preferably polyurethane, is disposed within the confined space between the top and bottom walls.

5 Claims, 5 Drawing Sheets

COIL SUPPORT PAN FOR AN AIR HANDLING UNIT

TECHNICAL FIELD

The invention relates to a basepan for a fan coil unit having spaced apart top and bottom walls formed from a plastic material and having an insulating material disposed therebetween. The top wall defines a coil support and condensate collection structure.

BACKGROUND ART

Residential and commercial air conditioners include air handling units, which include as a part thereof a heat exchanger and a fan which cooperate to direct air to be heated and/or cooled across the heat exchanger for direction to an enclosed area to be heated and/or cooled. It is well known to make such air handling units in a modular manner, wherein the modular units have common dimensions which allow them to be assembled in a variety of combinations depending upon the size of the installation and the location of the installation. The basic modules of such a system include a fan module, which typically includes a centrifugal fan and motor assembly, and a coil module which includes a heat exchange coil. The air passing through the heat exchange coil, during the air conditioning mode of operation creates condensation on the coil which drips downwardly upon the support structure for the heat exchange coil. Such support structure typically includes a condensation pan for collecting the condensate and conducting it by an appropriate outlet and pipe to a drain.

Condensate pans are generally made from a galvanized metal, and will rust with relative ease eventually resulting in leaking and water damage to underlying components of the system. Further, because the water collected in such pan is relatively cool, condensation on the lower side of the pan may result in an accumulation of water. which may also drip upon underlying components. Another undesirable characteristic of existing condensate pans is that they do not drain adequately and accordingly will collect condensate therein resulting in fungus growth, which in turn can cause odors and block drainage from the pan.

It is accordingly extremely desirable for a basepan to be fabricated from a material and in a manner which provides the following desirable characteristics: thermal insulation, acoustic insulation, resistance to corrosion, light weight, with structural integrity, good drainage of collected condensate, aesthetically pleasing, resistance to oils such as residues from fin coils and easily washable.

DISCLOSURE OF THE INVENTION

The invention relates to a support pan for a heat exchange coil in an air handling unit. The pan includes a top wall made from a polymeric/co-polymeric material. The top wall includes an outer periphery and defines a coil support region and a condensate collecting region. A bottom wall is substantially co-extensive with the top wall and has an outer periphery substantially coincident with that of the top wall. Peripheral support channels structurally engages the outer peripheries of the top wall and the bottom wall and supports the walls in substantially parallel spaced relationship with one another to define a confined space therebetween. The coil support region of the top wall includes a plurality of parallel coil support segments. Each of the support segments defines an upwardly facing support surface configured to contact and support a lower end of a coil at a predetermined elevation. The support segments are spaced from one another by a plurality of condensate collecting channels which are at an elevation lower than the predetermined elevation. The condensate collecting channels are in fluid communication with the condensate collecting region, which is at an elevation lower than that of the condensate collecting channels. An insulating material, preferably polyurethane, is disposed within the confined space between the top and bottom walls.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT OF THE INVENTION AND INDUSTRIAL APPLICABILITY

Figure 1:
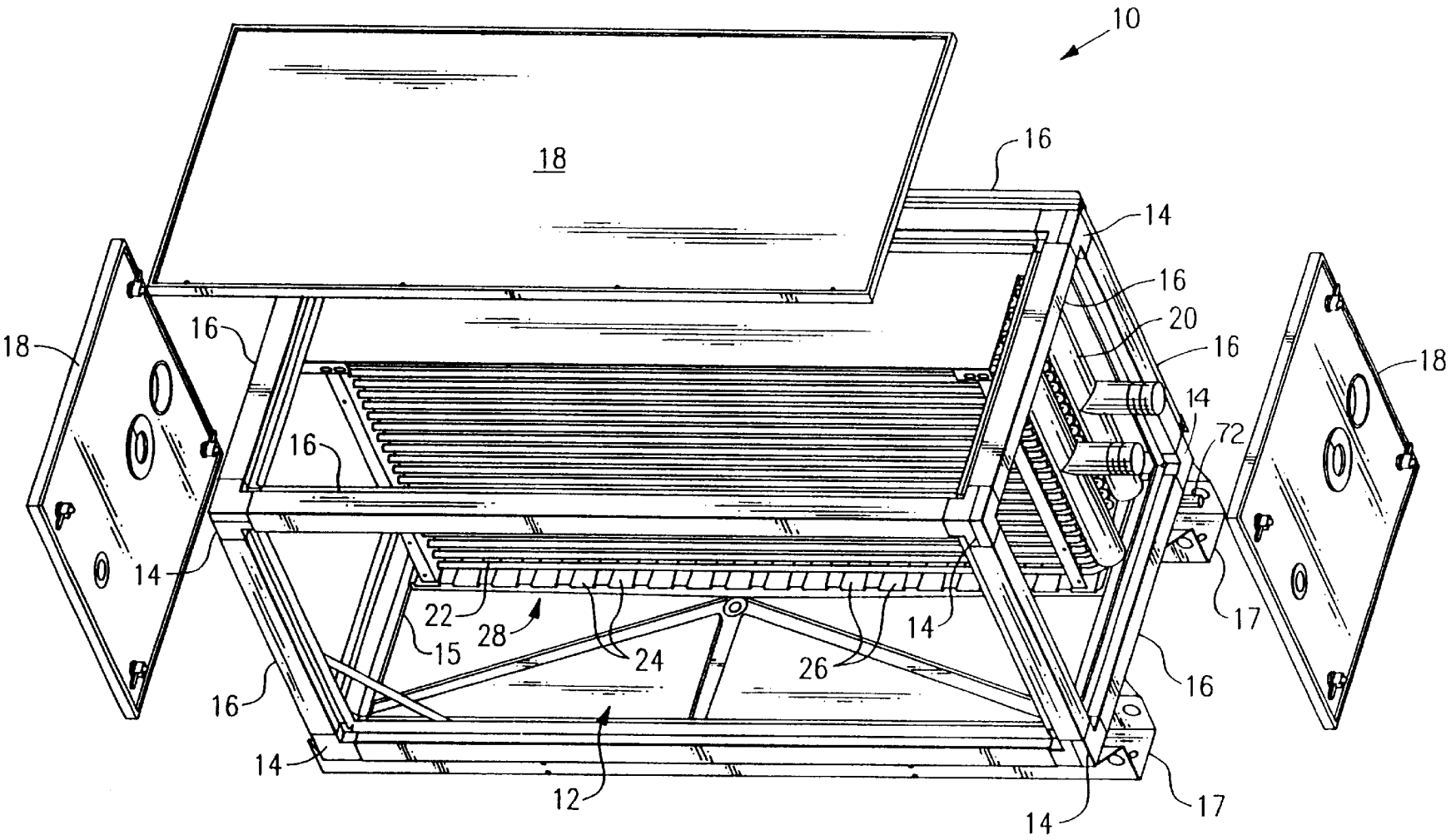
FIG. 1 is a perspective exploded view of a coil module having a coil support pan according to the invention.

A coil module 10 for use with an air handling unit having a coil support pan 12 according to the present invention is illustrated in FIG. 1. The coil module includes a substantially rectangular casing defined by a structural framework having eight corners 14 interconnected by a plurality of horizontally and vertically extending structural elements 16. The framework defined by the corners and the structural elements 16 is adapted to removably receive a plurality of outer panels 18, three of which are shown removed from the structure in FIG. 1.

The four lower most structural elements 16 define the rectangular support channel at the base of the unit in which the support pan 12 is mounted to form the structural bottom of the unit. The support pan 12 has peripheral edges which are adapted to be received in the groove 15 as the pan is installed from the underside of the module 10. A pair of structural channels 17 underlie and support the pan and are attached to the structural supports 16 by suitable threaded fasteners. A heat exchange coil 20 is vertically disposed within the coil module 10 and has a lower end 22, which rests upon upwardly facing support surfaces 24 formed on coil support segments 26 of a coil support region 28 of the support pan 12.

Figure 2:
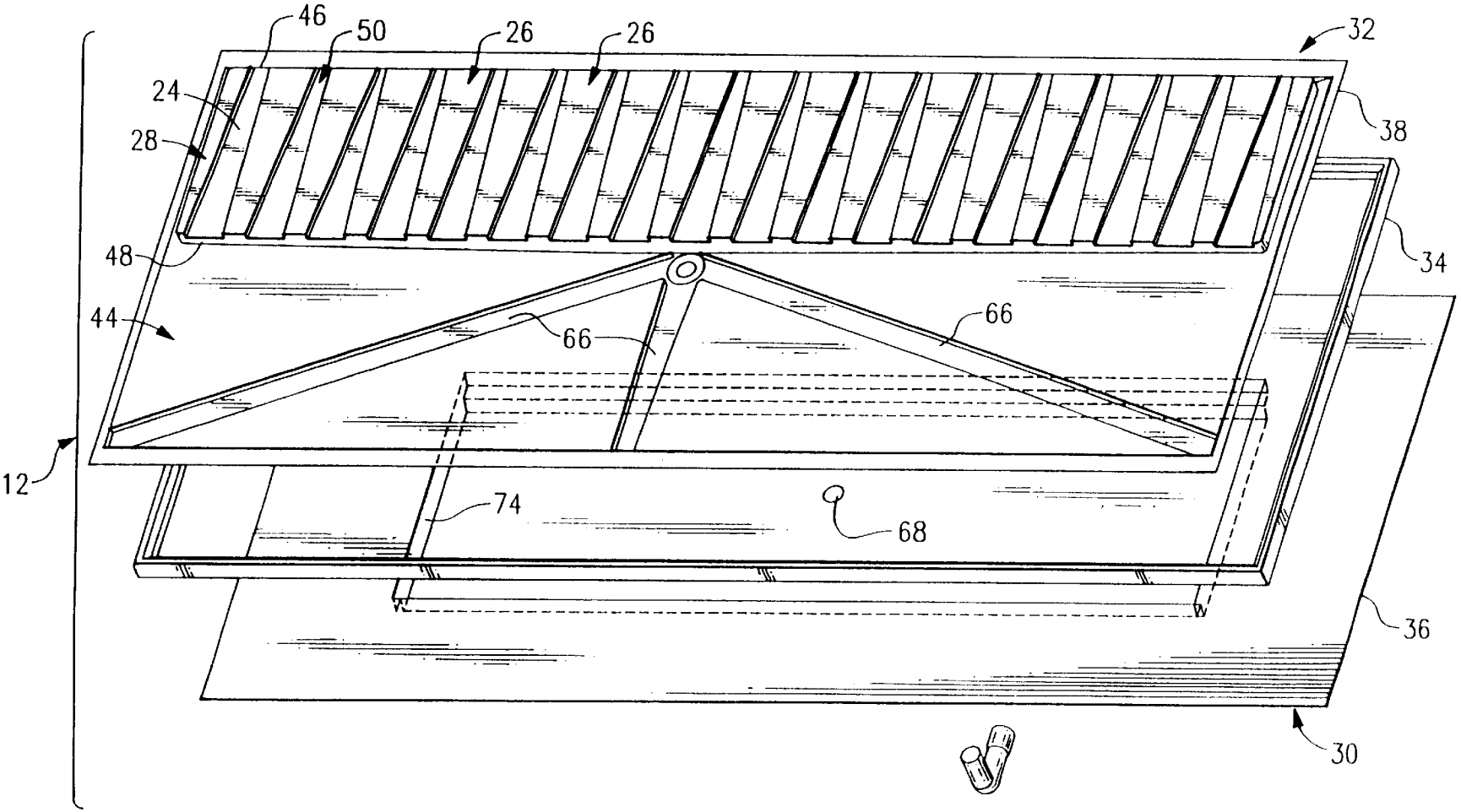
FIG. 2 is an enlarged exploded view of the support pan illustrated in FIG. 1.
Figure 4:
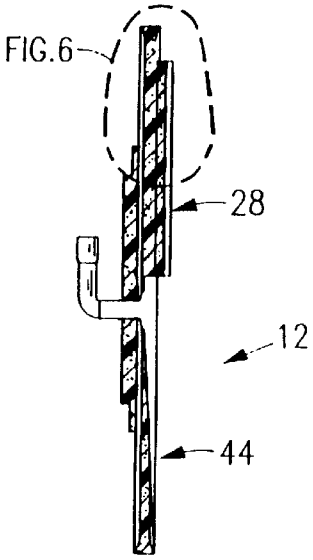
FIG. 4 is a sectional view taken along the lines 4—4 of FIG. 3.
Figure 3:
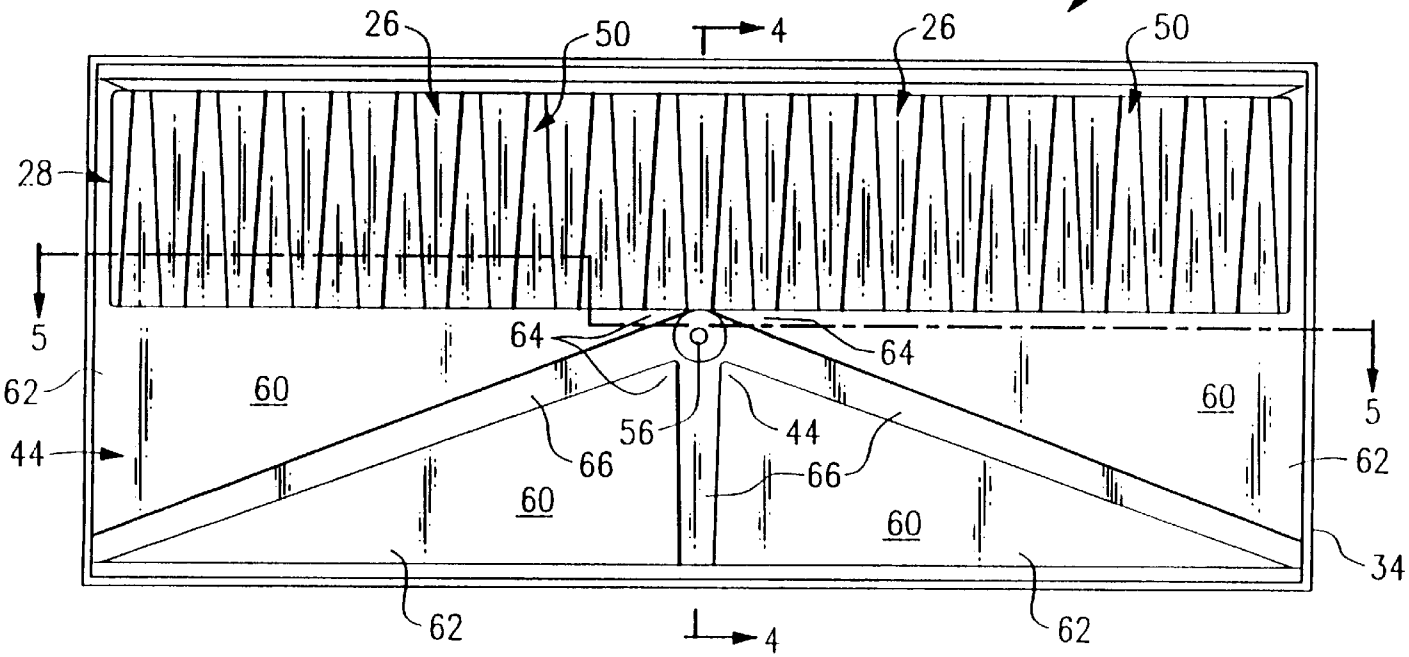
FIG. 3 is a top plan view of the basepan illustrated in FIG. 1.
Figure 5:
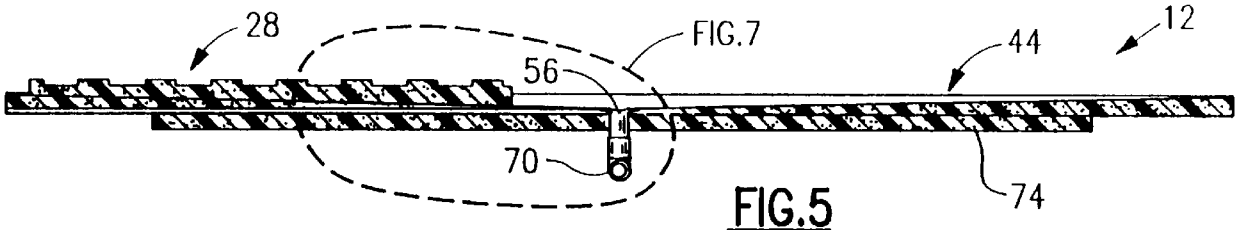
FIG. 5 is a sectional view taken along the lines 5—5 of FIG. 3.
Figure 7:
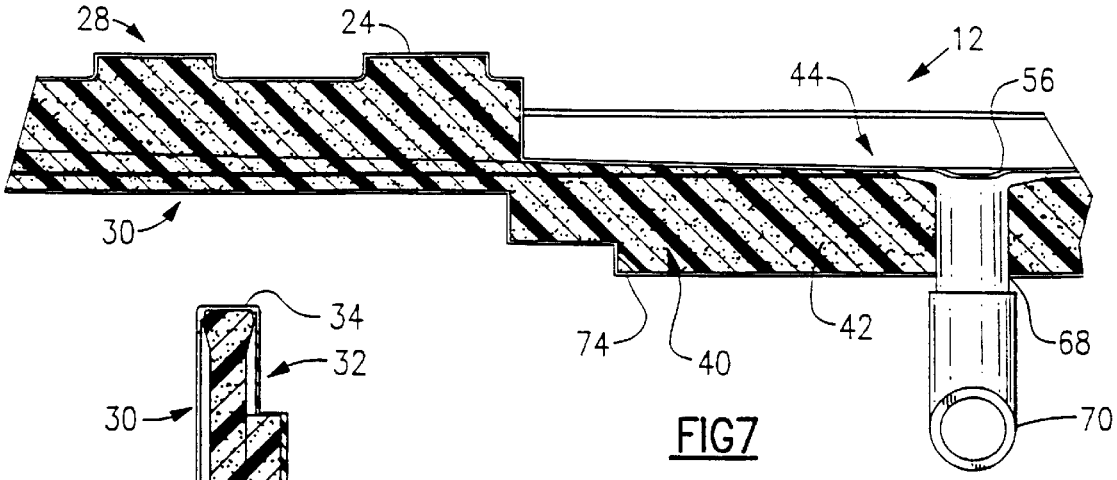
FIG. 7 is an enlarged view of the region identified as FIG. 7 in FIG. 5.
Figure 6:
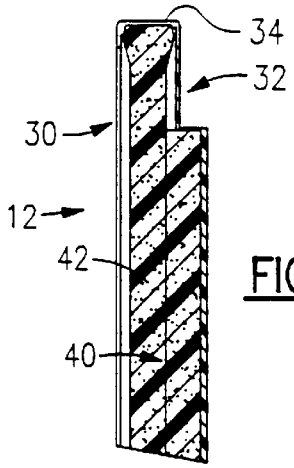
FIG. 6 is an enlarged view of the portion identified as FIG. 6 in FIG. 4.
Figure 8:
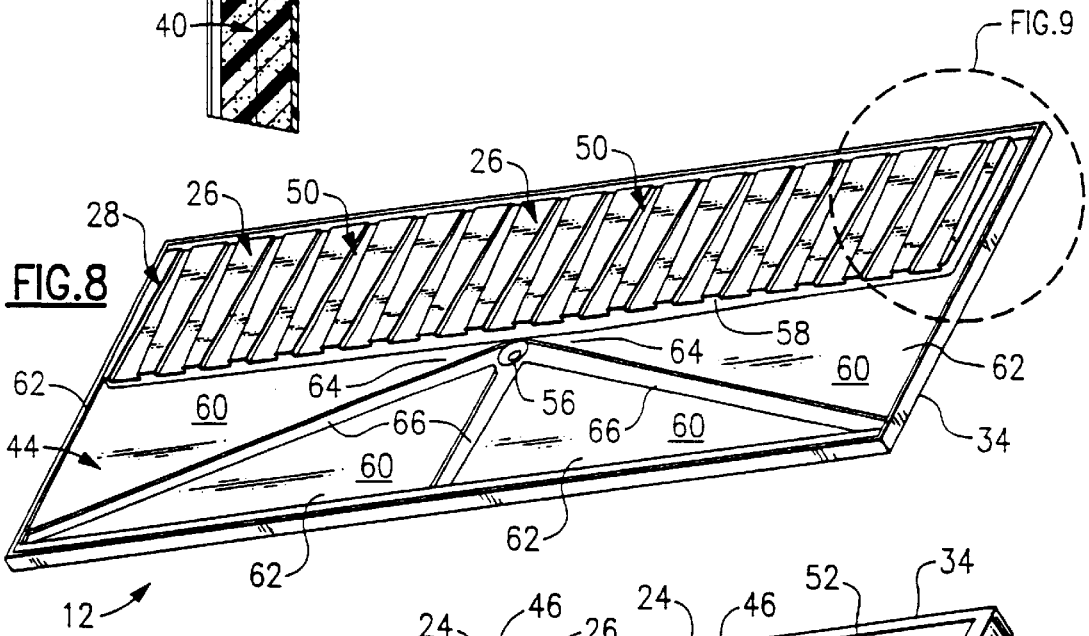
FIG. 8 is a perspective view of the basepan illustrated in FIG. 1.

FIGS. 2–9 illustrate the details of the support pan 12 removed from the coil module 10. As best seen in FIG. 2, the support pan 12 comprises a bottom wall 30, a top wall 32 and a peripheral support structure 34. As is best seen in FIGS. 2 and 6, the bottom wall 30 and top wall 32 each define peripherally extending outer edges 36 and 38, respectively. The outer edges 36 and 38 are configured to be received in a U-shaped channel. which defines the peripheral support structure 34. The channel is configured to receive the edges so as to support the bottom wall and top wall in substantially parallel spaced relationship with one another to thereby define a confined space 40 therebetween, as is shown in FIGS. 4–7. The confined space 40 between the bottom and top walls is filled with an insulating material 42, preferably an expanded polyurethane foam material, which may be injected into the confined space through a suitable opening provided in the peripheral support 34.

As pointed out above, the support pan 12 includes a coil support region generally identified by reference numeral 28 and, additionally, a condensate collecting region generally indicated by reference numeral 44. As best seen in FIG. 2, the condensate collection region 44 and the coil support region 28 both form part of the top wall 32. In a preferred embodiment the top wall is constructed from an in situ vacuum molded polymeric/co-polymeric material, such as high impact polystyrene, flexible polyethylene or, as in the preferred embodiment, ABS, which is not only non-corrosive but also resistant to oils which are used in the manufacture of the fins incorporated in the heat exchanger 20.

The coil support region 28 is defined by a plurality of support segments 26, which define upwardly facing coil support surfaces 24, which are configured to contact and support the lower end 22 of a heat exchange coil at a predetermined elevation. The support surfaces 24 have a first width at an end 46 adjacent a peripheral support 34 and taper to a narrower width at a distal end 48. Located between each of the support segments 26 are condensate collecting channels 50, which extend from a narrow dimension at a proximal end 52 adjacent the peripheral support 34 to a distal end 54 in fluid communication with the condensate collection region 44.

Figure 9:
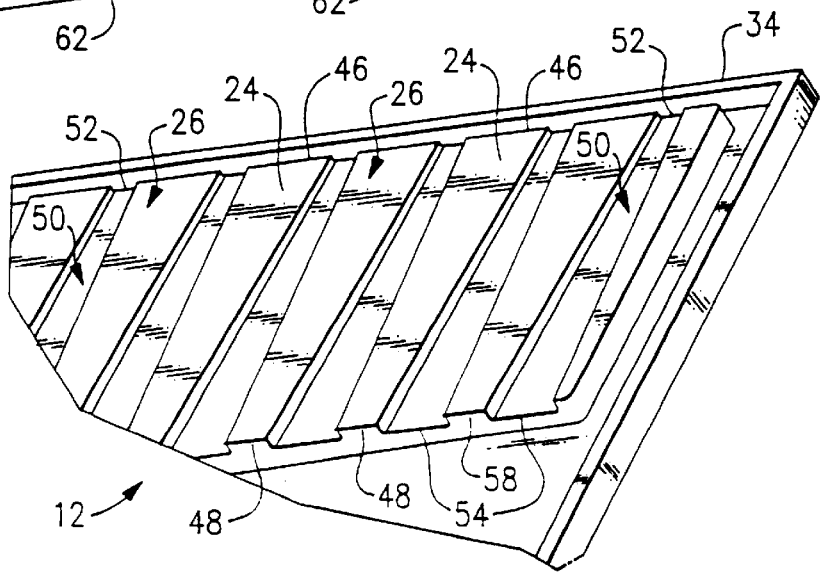
FIG. 9 is an enlarged view of the region identified as FIG. 9 in FIG. 8.
Figure 11:
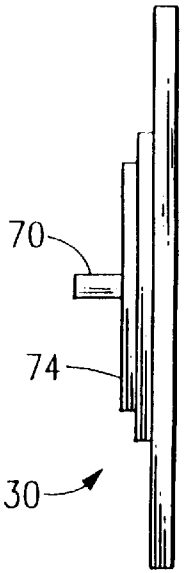
FIG. 11 is a side view of the wall of FIG. 10.

As best seen in FIG. 9, the proximal ends 52 of the channels 50 are at an elevation lower than the proximal ends 46 of the support surfaces 24 and extend downwardly in the direction of their distal ends 54 to an elevation which is lower than that of their proximal ends 52. As a result, condensate which falls into the condensate collecting channels 50 will follow, under the influence of gravity, the downward path defined by the sloped collecting channels 50 to delivery condensate to the distal ends 54 thereof and ultimately into the condensate collecting region 44.

Looking now at the condensate collection region 44, a drain opening 56 is positioned at the lower most elevation of the condensate collection region 44. In the illustrated embodiment, this is a position adjacent to a vertically extending wall 58, which extends from the condensate collection region 44 upwardly to the proximal ends 52 and 46 of the condensate collecting channels 50 and the support surfaces 24, respectively. The condensate collection region 44 is defined by four substantially triangular wall sections 60, each of which extends from a proximal end 62 adjacent the peripheral support structure 34 to distal ends 64, each of which terminate in close proximity to the drain opening 56.

Located between adjacent triangular walls 60 are three condensate drain channels 66, which are at an even lower elevational than the four triangular walls 60 and which are configured to assure the passage of condensate collected in the condensate collection region 44 to the drain opening 56. It should be appreciated that all levels of the four triangular walls 60 and the three channels 66 are at an elevational lower than the lower most elevation of the distal end 54 of the condensate collecting channels. As a result, all condensate coming from the heat exchange coil 20 downwardly into the condensate collecting channels 50 will be conducted into the condensate collection region 44 and ultimately to the drain opening 56.

Figure 10:
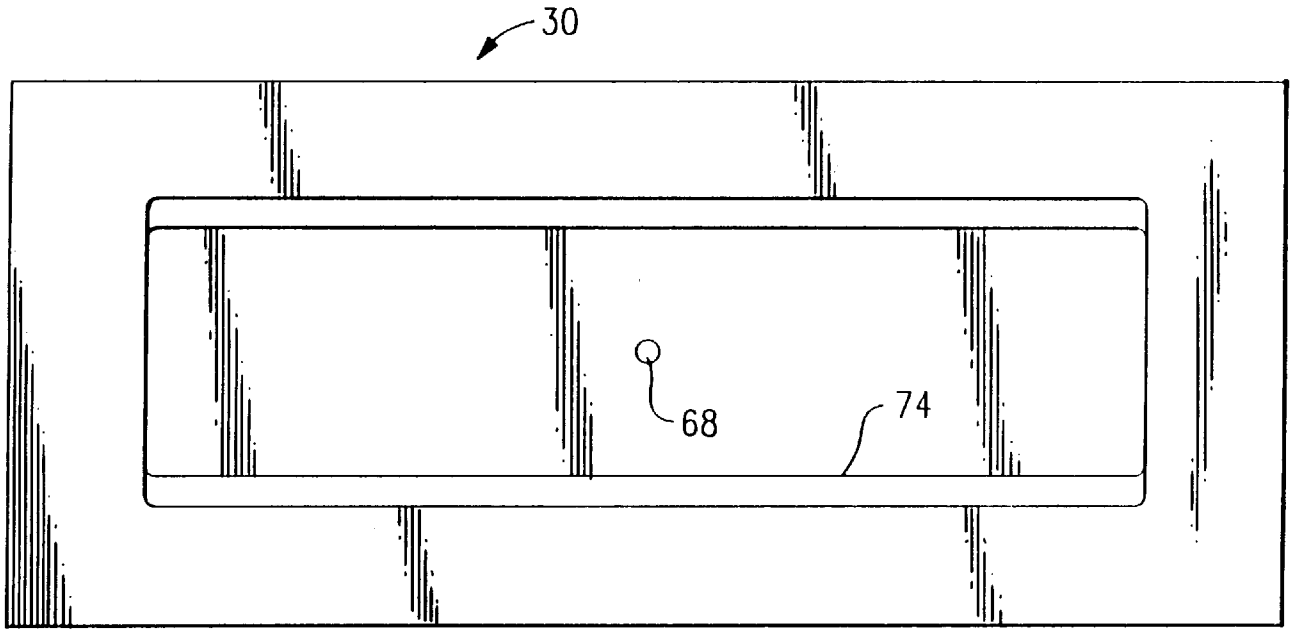
FIG. 10 is a top plan view of the bottom wall of the support pan.
Figure 12:
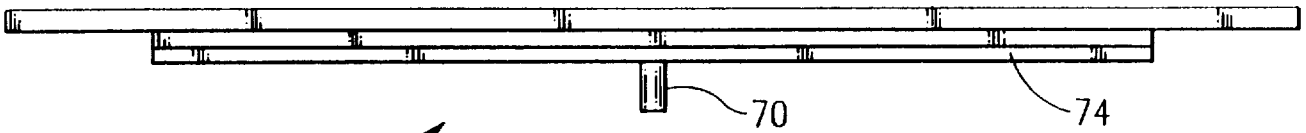
FIG. 12 is a front view of the wall of FIG. 10.

As is best seen in FIGS. 2 and 10, an opening 68 is provided in the bottom wall 30 in axial alignment with the drain opening 56 in the top wall 32. A suitable drain fixture shown in a representative fashion by right angle type fitting 70 is inserted into the drain openings 56 and 68 and is affixed thereto by a suitable adhesive. The fitting 70 is thus able to receive water passing through the drain openings 56 and 68 and carry such water to an appropriate disposal location. In a preferred embodiment such drain fixture may extend into one of the support channels 17 underlying the support pan 12 and extends outwardly where it in turn is fluidly interconnected with a suitable pipe passing to the ultimate disposal location. Such a pipe extending through the channel 17 is shown for illustrative purposes as reference numeral 72 in FIG. 1.

It will be noted in the drawing figures that the bottom wall 30 includes a rectangular stepped recess 74 surrounding the drain opening 68 through the bottom wall. This stepped recess 74 serves two purposes. First it assures that the injection of polyurethane foam 42 into the confined space 40 between the bottom and top walls 30 and 32 may be accomplished through a single opening and, secondly, it assures that adequate insulation 42 is provided in the confined space 40 in the region adjacent the drain openings where the bottom and top walls converge in order to provide the desired condensate drain path, as described above.

As indicated above, the top wall is preferably constructed from an in situ vacuum molded ABS material. In the preferred embodiment, the lower wall and the channels forming the peripheral support structure are made from poly-vinyl-chloride (PVC).

What is claimed is:

1. A support pan for a heat exchange coil, said support pan comprising:

a top wall made from a polymeric/co-polymeric material, said top wall having an outer periphery and defining a coil support region and a condensate collection region;

a bottom wall substantially coextensive with said top wall and having an outer periphery substantially coincident with said periphery of said top wall;

peripheral support structure configured to structurally engage said outer periphery of each of said top wall and said bottom wall and to support said walls in substantially parallel spaced relationship with one another to thereby define a confined space between said top wall, said bottom wall and said peripheral support structure;

said coil support region comprising:

a plurality of substantially parallel coil support segments, said support segments each defining an upwardly facing support surface configured to contact and support a lower end of a coil at a predetermined elevation;

said support segments being spaced from one another by a plurality of condensate collecting channels, said channels being at an elevation lower than said predetermined elevation;

said condensate collecting channels being in fluid communication with said condensate collection region, said condensate collection region being at an elevation lower than that of said condensate collecting channels.

2. The support pan of claim 1 wherein an insulating material is disposed within said confined space.

3. The support pan of claim 2 wherein said condensate collection region has a higher elevation adjacent said peripheral support structure and a lower elevation away from said peripheral support structure.

4. The support pan of claim 3 wherein said lower elevation is adjacent said coil support region, and wherein said top wall and said bottom wall are provided with axially aligned condensate drain openings at said lower elevation.

5. The support pan of claim 2 wherein said top wall is made from ABS, said bottom wall is made from poly-vinyl-chloride, wherein said support structure is made from poly-vinyl-chloride, and wherein said insulating material comprises polyurethane.

* * * * *